US008037577B2

(12) United States Patent
Chen

(10) Patent No.: US 8,037,577 B2
(45) Date of Patent: Oct. 18, 2011

(54) TOOL HANDLE

(75) Inventor: Tai Hung Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 372 days.

(21) Appl. No.: 12/404,645

(22) Filed: Mar. 16, 2009

(65) Prior Publication Data

US 2010/0229342 A1 Sep. 16, 2010

(51) Int. Cl.
*B25G 1/04* (2006.01)

(52) U.S. Cl. ..... 16/111.1; 81/490

(58) Field of Classification Search ..... 16/111.1, 16/110.1, 436; 81/177.4, 177.7, 490, 489
See application file for complete search history.

(56) References Cited

U.S. PATENT DOCUMENTS

| | | | | |
|---|---|---|---|---|
| 2,635,661 | A * | 4/1953 | Egan | 81/490 |
| 3,426,813 | A * | 2/1969 | Robertson | 81/490 |
| 5,174,178 | A * | 12/1992 | Disston, Jr. | 81/490 |
| 5,887,306 | A * | 3/1999 | Huang | 7/165 |
| 6,032,332 | A * | 3/2000 | Lin | 16/111.1 |
| 6,196,093 | B1 * | 3/2001 | Hu | 81/490 |
| 6,769,154 | B1 * | 8/2004 | Klein et al. | 16/412 |
| 7,051,626 | B1 * | 5/2006 | Chen et al. | 81/438 |
| 2002/0184979 | A1 * | 12/2002 | Fruhm | 81/490 |
| 2004/0094000 | A1 * | 5/2004 | Liao | 81/490 |
| 2006/0254396 | A1 * | 11/2006 | Hu | 81/177.4 |
| 2006/0288531 | A1 * | 12/2006 | Hu | 16/111.1 |

FOREIGN PATENT DOCUMENTS

TW M273426 8/2005

* cited by examiner

*Primary Examiner* — Chuck Y. Mah
(74) *Attorney, Agent, or Firm* — Bacon & Thomas, PLLC

(57) ABSTRACT

A handle for hand tools, the handle comprises a grip member including a first end having a first receiving section and a second end, with the first receiving section opened to the distal of the first end; a storage unit including a storage member slideably received in the first end of the grip member and a shifted member pivotally connected to the storage member and fitted on an opening of the first receiving section so that the shifted member is adapted to be gripped to draw the storage unit out from the grip member; wherein when the shifted member in an original position, it hooks both of the first end of the grip member and the storage member as to prevent the storage unit detaching from the grip member; and a shank member tightly coupled to the second end of the grip member.

12 Claims, 10 Drawing Sheets

TOOL HANDLE

BACKGROUND OF THE INVENTION

1. Field of the Invention

The present invention relates to a handle having a grip member and a storage unit which is slideably received in the grip member and adapted for storing bits.

2. Description of the Related Art

Referring to Taiwan Patent No M273426, a wrench handle includes a handle portion and a shank coupled to the handle portion. The handle portion consists of a base member and a cap member slideably installed onto the base member. A receptacle is defined between the base and cap members and adapted for storing a plurality of bits.

However, while users want to take the bits stored in the receptacle, it needs to drive the cap member away from the base member, and then the base member is exposed to outside of the handle portion. Therefore, it is not easy to take bits from the wrench handle and when removal of the bits from the handle, users can not convenient to grip on the handle portion.

The present invention is therefore intended to obviate or at least alleviate the problems encountered in prior art.

SUMMARY OF THE INVENTION

According to the present invention, a handle for hand tools includes a grip member, a storage unit received in a first end of the grip member and a shank member coupled to a second end of the grip member and used as a socket. The storage unit includes a shifted member, a storage member adapted for storing bits and an elastic member. The shifted member is pivotally connected to a first section of the storage member and the storage member selectively pushes the elastic member. The shifted member has first and second hooks adapted for holding the shifted member to the grip member and the storage member as to prevent the storage unit detaching from the grip member.

It is an aspect of the present invention that the bit, which is adapted for coupling to the shank member in use, is stored inside of the grip member. It save area and space for storing the handle, and the handle can be easy to be carried.

It is another aspect of the present invention that the storage member of the storage unit includes slide rails so that the storage unit can be easy and convenient to be drawn out of the grip member by users.

It is yet another aspect of the present invention that portions of the first end of the grip member that are adapted for receiving the storage unit is concealed inside of the grip member so that even if users desire to take the storage unit out from the grip member, it is still easy to grip on the grip member without discomfort.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE PREFERRED EMBODIMENT

Figure 1:
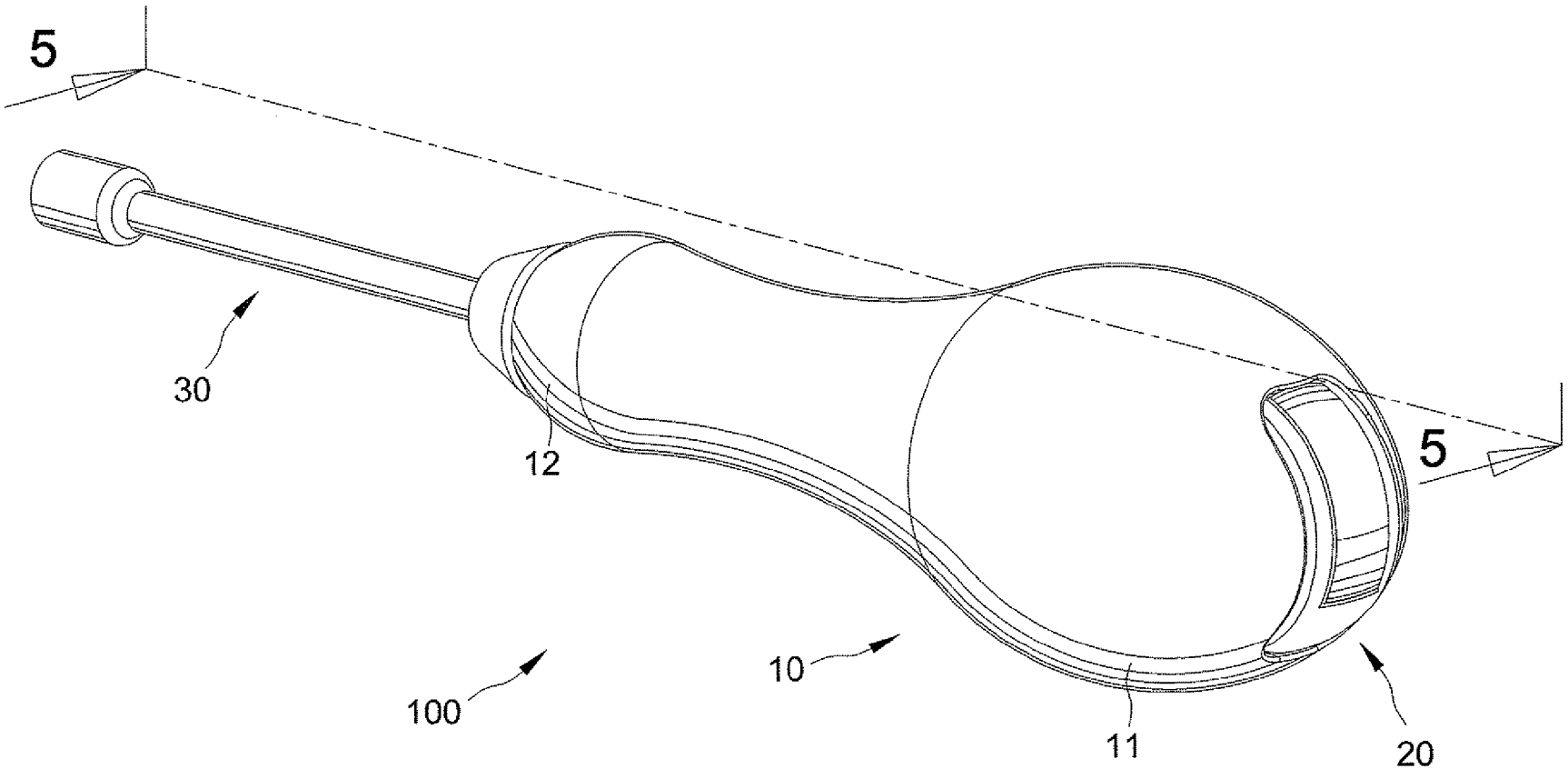
FIG. 1 is a perspective view of a handle in accordance with the first embodiment of the present invention.
Figure 2:
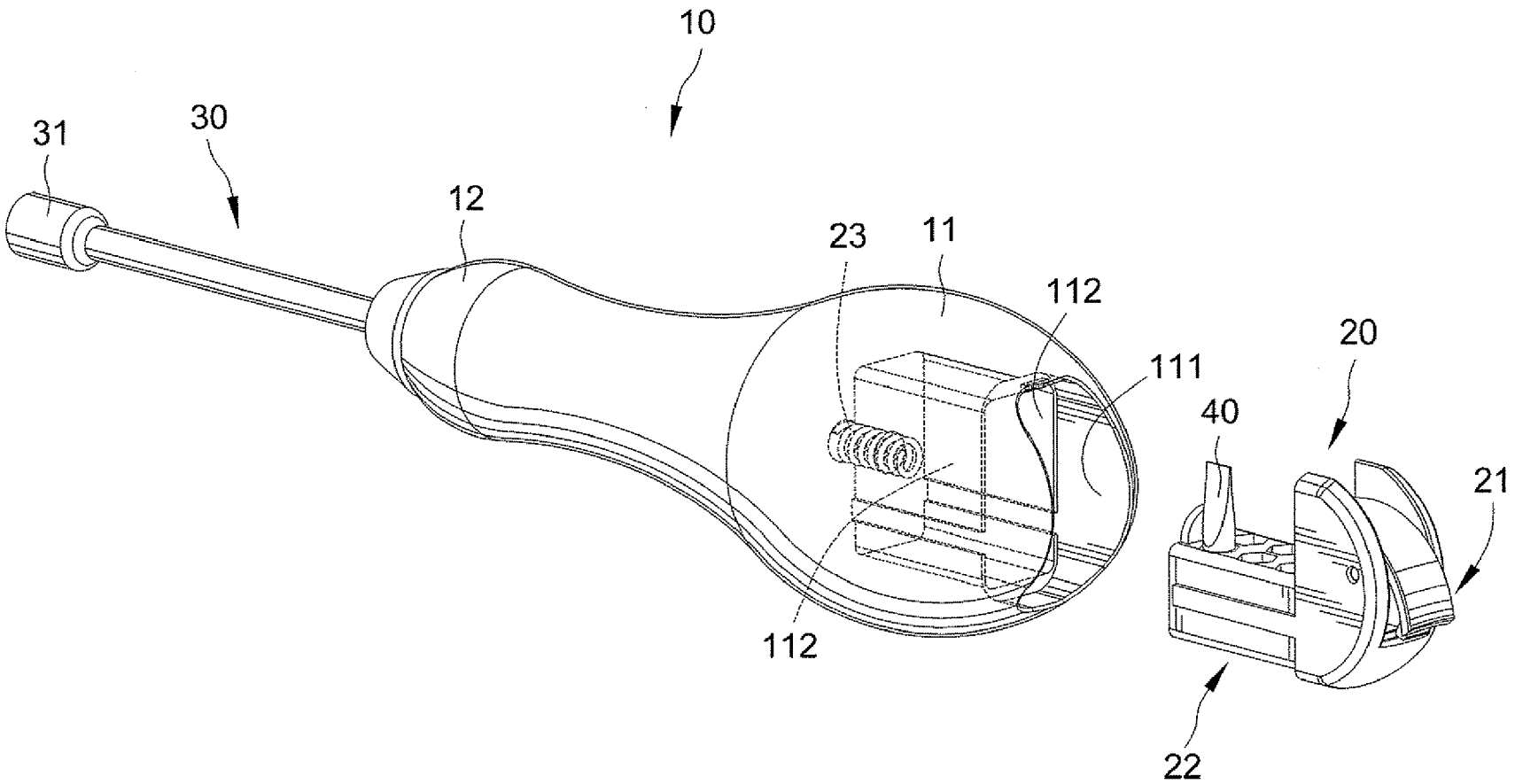
FIG. 2 is a partial, exploded perspective view of the handle shown in FIG. 1.
Figure 3:
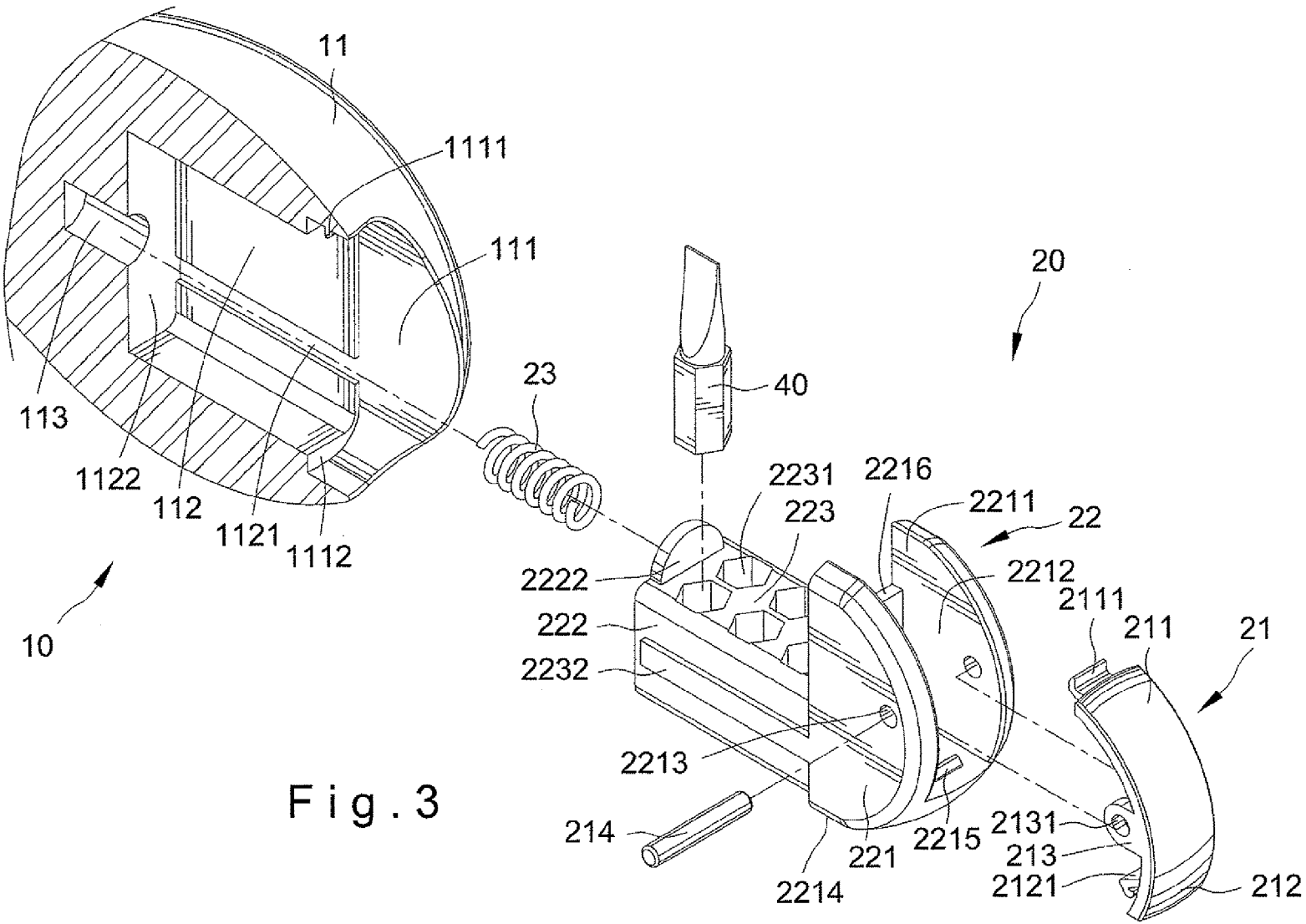
FIG. 3 is an enlarged, exploded perspective view of the handle shown in FIG. 2.
Figure 4:
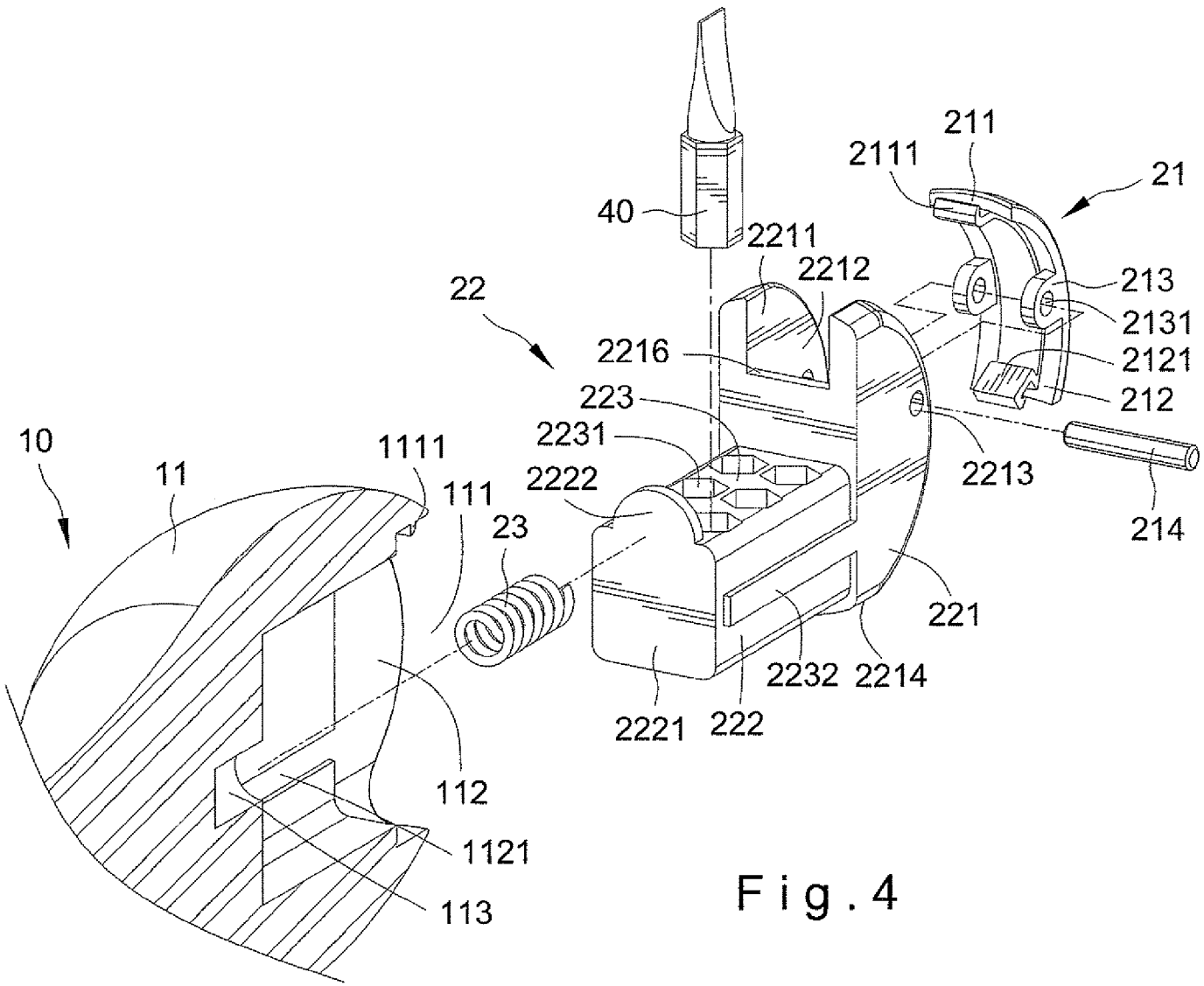
FIG. 4 is another enlarged, exploded perspective view similar to FIG. 3.
Figure 5:
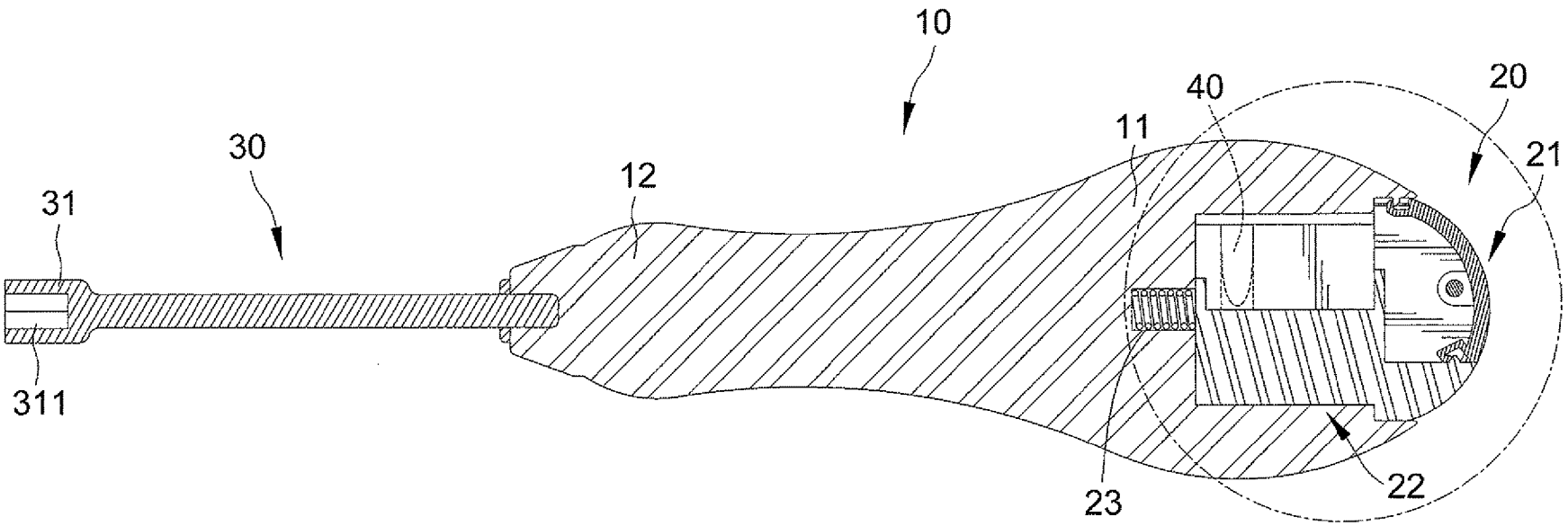
FIG. 5 is a cross-sectional view taken along 5-5 in FIG. 1.
Figure 6:
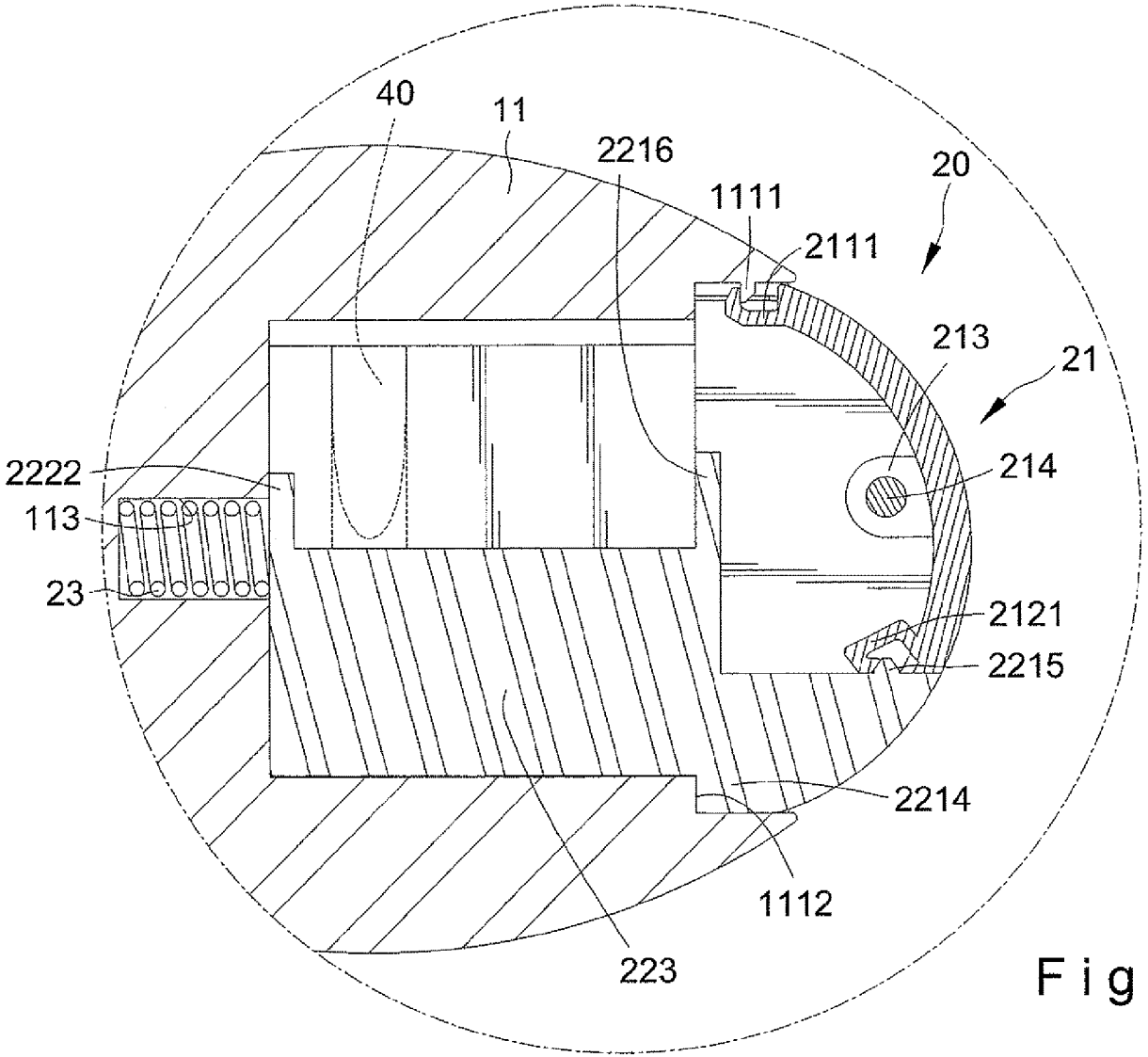
FIG. 6 is an enlarged view of a storage unit of the handle shown in FIG. 5.

FIGS. 1 through 9 show a handle 100 for hand tools in accordance with a first embodiment of the present invention. The handle 100 includes a grip member 10, a storage unit 20 slideably received in a first end 11 of the grip member 10 and a shank member 30 coupled to a second end 12 of the grip member 10 opposite to the storage unit and used as a socket. The shank member 30 includes a socket end 31 being opposite to the grip member 10 and having a coupled hole 311. The coupled hole 311 is adapted to couple to a bit 40 (shown in FIGS. 2 through 9) in use.

The grip member 10 is preferably calabash-shaped, in this embodiment, and a cross-sectional area of the first end 11 becomes larger than that of the second end 12. The storage unit 20 is slideably and removably received in the first end 11 of the grip member 10, and the first end 11 is formed with first, second and third receiving sections 111, 112, 113 which are defined inside of the grip member 10. The first receiving section 111 is opened to outside of the grip member 10 so that the storage unit 20 is able to insert into the grip member 10 from the first receiving section 111. The second receiving section 112 is abutted against and sandwiched between the first and third receiving sections 111, 113. An end of the second receiving section 112 that abuts with the first receiving section 111 is opened, and the other end of the second receiving section 112 that abuts with the third receiving section 113 is closed. The third receiving section 113 is preferably a recess axially formed on and opened to the center of the other end of the second receiving section 112. The second end 12 of the grip member 10 is used for a tight installation of the shank member 30 to the grip member 10. Moreover, the second and third receiving sections 112, 113 are both concealed inside of the first end 11 of the grip member 10.

The first receiving section 111 is approximately semicircle and includes a first holding portion 1111 and a first blocking portion 1112 defined at the inner periphery of the top and bottom thereof.

The second receiving section 112 is rectangular and includes two slide channels 1121 respectively formed on two lateral sidewalls and a second blocking portion 1122 is defined at the other end thereof.

The storage unit 20 consists of a shifted member 21, a storage member 22 and an elastic member 23. The elastic member 23 is extensibly received in the third receiving section 113, and the storage member 22 is slideably received in the second receiving section 112 and pushes against the elastic member 23.

The shifted member 21 is pivotally connected to the storage member 22 and includes first and second ends 211, 212. The shifted member 21 has an arcuate piece shaped, and while a combination of the shifted member 21 and the storage member 22 is totally received in the first end 11, a profile of the first end 11 of the grip member 10 is smooth without any prominence on its surface. First and second hooks 2111, 2121 respectively extend from the first and second ends 211, 212 of the shifted member 21.

The storage member 22 has a first section 221 coupled to the shifted member 21 and removably disposed in the first receiving section 111 and a second section 222 opposite to the shifted member 21. The second section 222 further has an abutted portion 2221, which is able to abut with the second blocking portion 1122 and push the elastic member 23 while the storage unit 20 is totally received in the first end 11 of the grip member 10, and a semi-circle restricting portion 2222 longitudinally extending from the top of the abutted portion 2221 for preventing an interference between the elastic member 23 and the bit 40.

The first section 221, which is preferably semi-circle and corresponds to the profile of the first receiving section 111, consist of two semi-circle lateral walls 2211, which are spaced from each other by a receptacle 2212, and a bottom edge 2214 provided to abut with both of the first blocking portion 1112 and the bottom of the first receiving section 111. A bordering portion 2216 is defined between the receptacle 2212 and the storage portion 223. And a horizontal position of the top edge of the bordering portion 2216 is lower than that of the lateral walls 2211. A second holding portion 2215 is formed on the bottom of the receptacle 2212 and proximal to the shifted member 21. Two coupled portions 213, which extend from two lateral sides of the shifted member 21, respectively, between the first and second ends 211, 212 and spaced from each other, are respectively abutted with the lateral walls 2211. A coupled hole 2131 is formed on each coupled portion 213, and a coupled hole 2213 is formed on each lateral wall 2211 and corresponds to the related coupled hole 2131. A pin 214 is provided to insert through the coupled holes 2131, 2213 for pivotally connecting the shifted and storage members 21, 22 to each other.

Further, while the shifted member 21 is in an original position, the profile of the shifted member 21 is fit on the receptacle 2212 and the first and second hooks 2111, 2121 are respectively held by the first and second holding portions 1111, 2215 as to prevent the shifted member 21 detaching from the storage member 22 and the storage unit 20 detaching from the first end 11 of the grip member 10.

A storage portion 223 is defined between the first and second sections 221, 222 and longitudinally forming a plurality of hexagonal storage recesses 2231 thereon storing the bit 40. Two slide rails 2232 are defined on two sidewalls of the storage portion 223 and correspond to the slide channels 1121; thus, the storage member 22 is able to slide with respect to the second receiving section 112 via a cooperation of the slide rails 2232 and the slide channels 1121.

Figure 7:
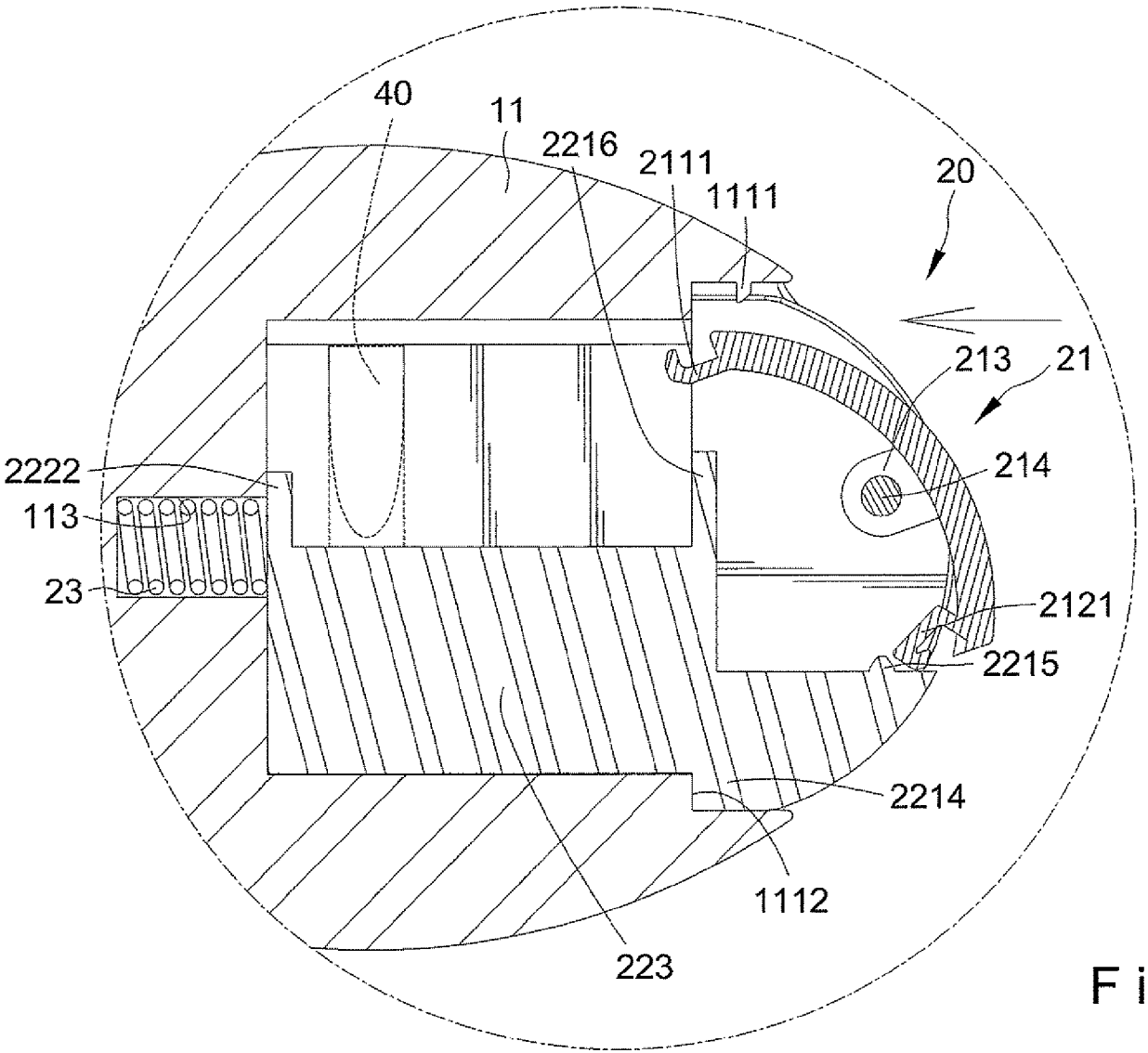
FIG. 7 is another enlarged view of the storage unit of the handle similar to FIG. 6, illustrating that a shifted member of the storage unit is pressed toward the grip member and first and second hooks of the shifted member are driven to detach from first and second holding portions of handle for a removal of the storage unit from the grip member.
Figure 8:
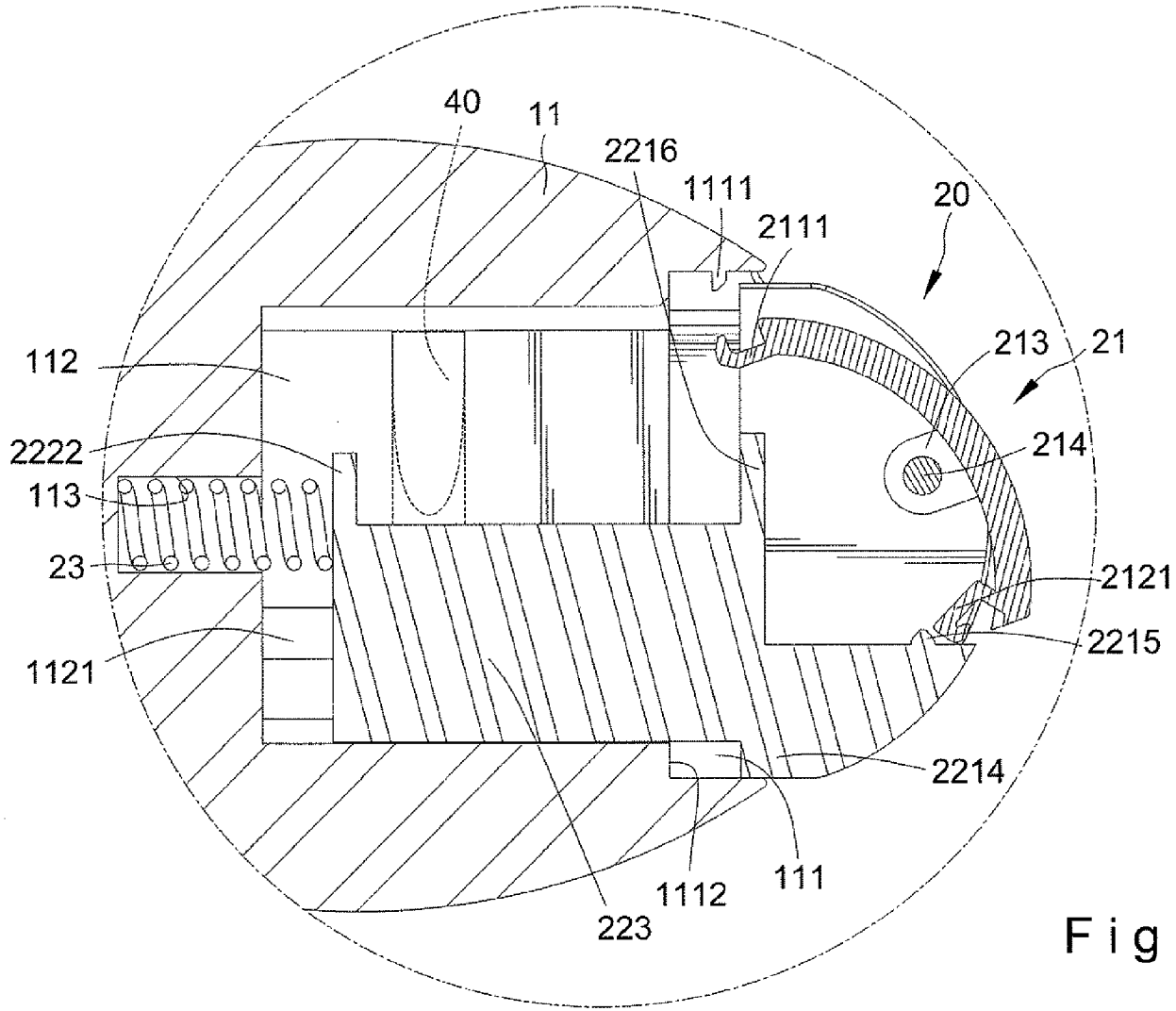
FIG. 8 is yet another enlarged view of the storage unit of the handle similar to FIG. 7.
Figure 9:
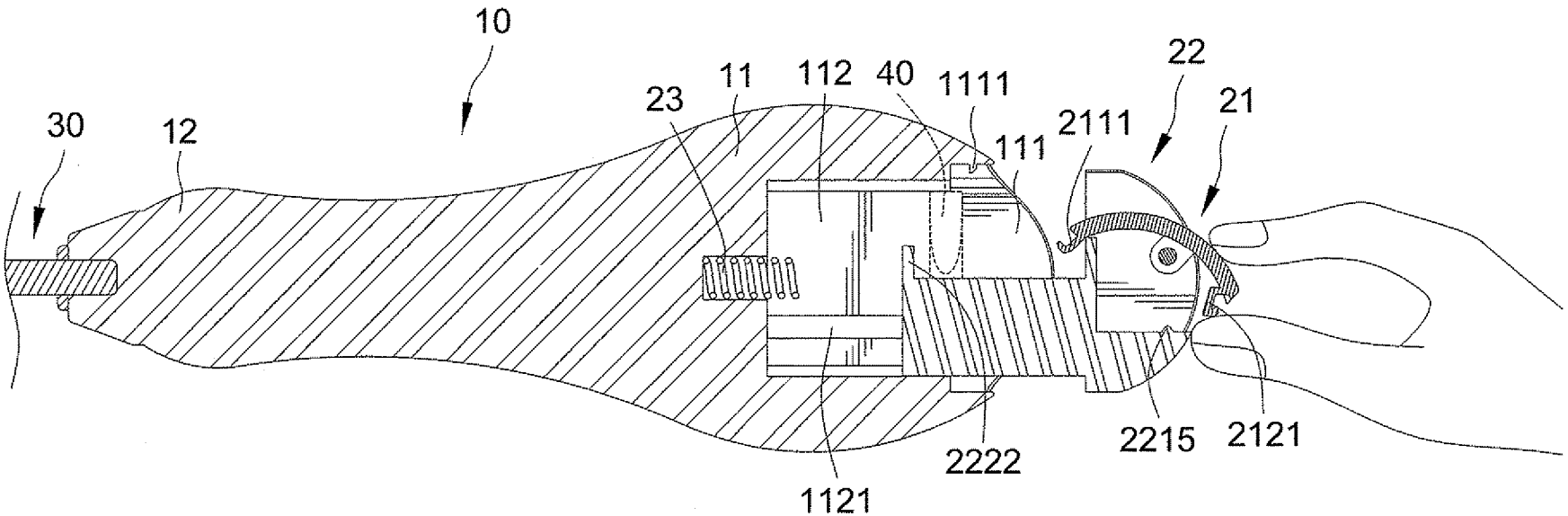
FIG. 9 is a partial, cross-sectional view of the handle shown in FIG. 1, illustrating that a user grips the shifted member to slide the storage unit away from the grip member.

Specifically referring to FIGS. 7 through 9, they show that while a user desires to take out the bits stored in the storage unit 20, firstly, the user has to push the first end 211 of the shifted member 21 toward the storage member 22, as indicated by arrow shown in FIG. 7. And then, the shifted member 21 is driven to pivot with respect to the pin 214 as to detach the first and second hooks 2111, 2121 from the first and second holding portions 1111, 2215. In the same time, the elastic member 23 is released and pushes the storage member 22 toward the shifted member 21 and the storage member 22 is driven to slide along the second receiving section 112 via the cooperation of the slide rails 2232 and the slide channels 1121. As the shifted member 21 lasts to pivot toward the storage member 22 till the first end 211 of the shifted member 21 is abutted against the bordering portion 2216, the user can grip the second end 212 of the shifted member 21 to draw the storage unit 20 to slide out of the first end 11 of the grip member 10 (shown in FIG. 9). And the bit 40 is exposed from the grip member 10 and can be taken out of the handle 100.

Figure 10:
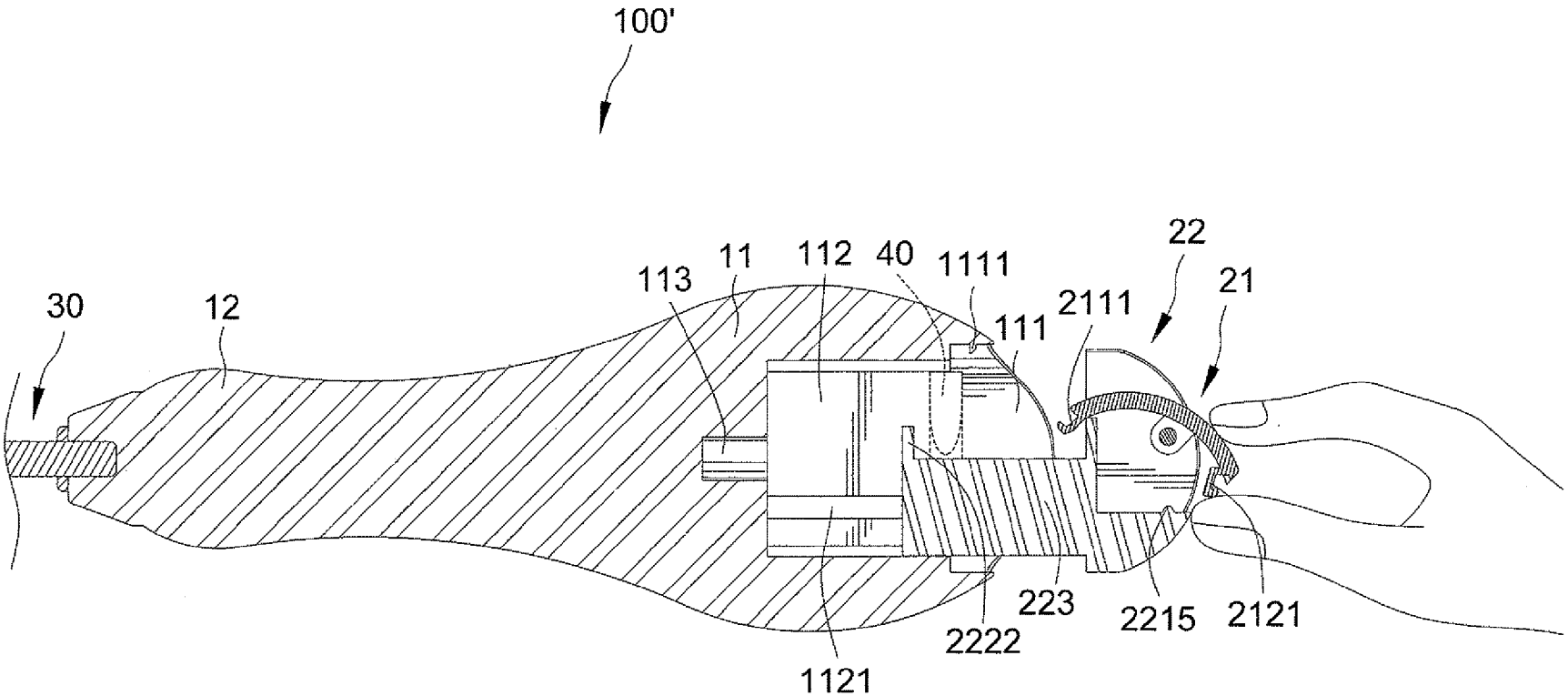
FIG. 10 is a partial, cross-sectional view of a handle in accordance with the second embodiment of the present invention.

Referring to FIG. 10, it shows a handle 100' for hand tools in accordance with a second embodiment of the present invention. The handle 100' is similar to the handle 100 except for omitting the elastic member 23.

While the specific embodiments have been illustrated and described, numerous modifications come to mind without significantly departing from the spirit of invention and the scope of invention is only limited by the scope of accompanying claims.

What is claimed is:

1. A handle for hand tools, the handle comprising:

a grip member including a first end having a first receiving section and a second end, with the first receiving section being opened towards a distal of the first end;

a storage unit including a storage member for storing a plurality of bits, the storage member being slideably received in the first end of the grip member, a shifted member pivotally connected to the storage member and fitted on an opening of the first receiving section so that the shifted member is adapted to be gripped to draw the storage unit out from the grip member and the shifted member including a hook means;

wherein when the shifted member is disposed in a first pivot position, the hook means engages both the first end of the grip member and the storage member to prevent the storage unit detaching from the grip member;

wherein when the shifted member is disposed in a second pivot position, the hook means disengages from the first end of the grip member and the storage member, thereby permitting the storage unit to be drawn out of the first end of the grip member; and a shank member tightly coupled to the second end of the grip member for engagement by a selected bit from the storage member.

2. The handle as claimed in claim 1 wherein the hook means of the shifted member comprises a first hook and a second hook defined at a first end and a second end thereof respectively, wherein the first receiving section includes a first holding portion defined at an inner periphery of a top thereof and the storage member includes a receptacle and a second holding portion formed on the bottom of the receptacle, with the first and second hooks engaging the first and second holding portions when the shifted member is in the first pivot position.

3. The handle as claimed in claim 1 wherein the storage member further includes a first section to which the shifted member is pivotally connected, a second section disposable inside of the first end of the grip member and, the second section defining a storage portion for storing the bits.

4. The handle as claimed in claim 3 wherein the hook means of the shifted member includes a first hook and a second hook defined at a first and a second end thereof respectively, wherein the first receiving section includes a first holding portion defined at an inner periphery of a top thereof and the first section of the storage member includes a receptacle and a second holding portion formed on a bottom of the receptacle, with the first and second hooks being engageable with the first and second holding portions when the shifted member is in the first pivot position.

5. The handle as claimed in claim 4 wherein the first section of the storage member is of semicircular configuration and corresponds to a profile of the first receiving section when the shifted member is disposed in the first pivot position; and wherein the first section includes two semicircular lateral walls spaced from each other by the receptacle.

6. The handle as claimed in claim 5 further comprising two coupled portions extending from two lateral sides of the shifted member and positioned between the first and second ends of the shifted member, and the coupled portions being spaced from each other for abutting the lateral walls of the storage member.

7. The handle as claimed in claim 6 further comprising a coupled hole formed on each coupled portion of the shifted member, and a coupled hole formed on each lateral wall of the first section of the storage member corresponding to the coupled holes of the shifted member for receiving a pin to pivotally connect the shifted and storage members to each other.

8. The handle as claimed in claim 1 further comprising a second receiving section disposed inside the first end of the grip member and positioned between the first receiving section and the second end of the grip member, with the first and second sections of the storage member being respectively disposable in the first and second receiving sections when the storage unit is totally received in the grip member.

9. The handle as claimed in claim 8 wherein the storage member includes two slide rails respectively defined on two sidewalls thereof and the second receiving section includes two slide channels respectively formed on two lateral sidewalls thereof, wherein the storage member is able to slide with respect to the second receiving section through engagement of the slide rails and the slide channels.

10. The handle as claimed in claim 8 further comprising a third receiving section defined inside of the first end of the grip member, with the second receiving section being positioned between the first and third receiving sections, and an elastic member disposed in the third receiving section for engaging the storage unit.

11. The handle as claimed in claim 1, with the shifted member is of an arcuate configuration, and when the shifted member and the storage member are totally received in the first end of the grip member the first end of the grip member forms a smooth surface.

12. The handle as claimed in claim 1 wherein the storage member includes a plurality of hexagonal storage recesses for storing the bits.

* * * * *